US005942101A

United States Patent [19]

Greaney

[11] Patent Number: 5,942,101

[45] Date of Patent: Aug. 24, 1999

[54] METHOD FOR DECREASING THE CONRADSON CARBON NUMBER OF PETROLEUM STREAMS

[75] Inventor: Mark Alan Greaney, Upper Black Eddy, Pa.

[73] Assignee: Exxon Research and Engineering Co., Florham Park, N.J.

[21] Appl. No.: 08/987,751

[22] Filed: Dec. 9, 1997

[51] Int. Cl.[6] ..... C25B 1/00

[52] U.S. Cl. ..... 205/688; 205/695; 205/696; 204/514; 204/559; 204/567

[58] Field of Search ..... 205/688, 695, 205/696; 204/514, 559, 567

[56] References Cited

U.S. PATENT DOCUMENTS 744,171 11/1903 Davis et al. ..... 204/514

2,140,194 12/1938 Yabroff et al. ..... 204/9

5,514,252 5/1996 Kerby, Jr. et al. ..... 204/514

*Primary Examiner*—Arun S. Phasge

*Attorney, Agent, or Firm*—Linda M. Scuorzo

[57] ABSTRACT

The present invention provides for a process for electrochemically decreasing the Conradson carbon number of petroleum streams by contacting a Conradson carbon containing petroleum stream and an aqueous electrolysis medium with a low hydrogen overpotential metal cathode at an electric current and pH sufficient to decrease the Conradson carbon of the petroleum stream. The cathode voltage is from 0 V to −3.0 V vs. SCE at a pH of from 7 to 14. The cathode material typically is stainless steel, chromium, copper and nickel.

13 Claims, No Drawings

METHOD FOR DECREASING THE CONRADSON CARBON NUMBER OF PETROLEUM STREAMS

FIELD OF THE INVENTION

The present invention relates to a method for electrochemically decreasing the Conradson carbon number of refinery feedstreams.

BACKGROUND OF THE INVENTION

Conradson carbon ("Concarbon") number ("CCN") is a measure of the characteristic tendency or propensity of a petroleum feedstream to form coke during processing. Feedstreams having a lower Concarbon number are more economically desirable as refinery feeds than feedstreams having a higher concarbon number. For example, U.S. Pat. No. 5,514,252 discloses reductive electrochemical treatment of refinery streams which occurs at specified cathodic voltage to decrease Conradson carbon number. High hydrogen overpotential cathodes such as lead and mercury are disclosed. There is a continuing need for additional processes for reducing the Concarbon number of feedstreams. Applicant's invention addresses this need.

SUMMARY OF THE INVENTION

The present invention provides for a method for decreasing the Conradson carbon number of petroleum streams comprising passing an electric current through a Conradson carbon-containing petroleum stream and an aqueous electrolysis medium, in the presence of a cathode having a low hydrogen overpotential at a sufficient cathodic potential and at a pH sufficient to produce a treated petroleum stream having a decreased Conradson carbon number.

The present invention may suitably comprise, consist or consist essentially of the described elements and may be practiced in the absence of an element not disclosed.

DETAILED DESCRIPTION OF THE INVENTION

The present invention provides for a method for electrochemically decreasing the Conradson carbon number of a petroleum stream or fraction by contacting a mixture or solution of a Conradson carbon-containing hydrocarbonaceous petroleum fraction or phase (also referred to herein as a stream or feed or feedstream) and an aqueous electrolysis medium with a low hydrogen overpotential cathode at a cathodic electric current and pH sufficient to decrease the Conradson carbon number of the stream (i.e., to produce a petroleum fraction having decreased Conradson carbon number). The petroleum stream and aqueous electrolysis medium are contacted under conditions to result in passing of an electric current therethrough. Thus electrolytic reduction at the cathode of the electrolytic cell yields petroleum streams or fractions having a decreased Conradson carbon number from the starting material.

Conradson carbon number correlates with the coke residue forming potential or propensity of petroleum streams. Petroleum streams having a high coke make typically have a deleterious effect on a number of petroleum refinery processes, such as fluid catalytic cracking, hydrotreating, coking, visbreaking, deasphalting and pipestill operations. In addition, coke is currently the lowest value refinery product, and thus generation of large quantities is not economically desirable. The higher the Concarbon number the greater the number or size of the refinery units typically needed to process the resulting coke residue. Therefore, decreasing the Conradson carbon content or number of a petroleum stream or fraction can decrease or eliminate the need to treat or dispose of the resulting coke.

The art teaches that reductive electrochemistry in the presence of an aqueous medium must be carried out using high hydrogen overpotential cathodes in order to minimize hydrogen evolution at the cathode. High hydrogen overpotential metals typically include lead, cadmium, zinc, mercury, tin, and alloys thereof (see, e.g., Danly, *Hydrocarbons Processing,* p. 163, April 1981). The use of low hydrogen overpotential materials can lead to hydrogen production at the cathode which is an undesirable competing reaction (at Applicant's process conditions) that can lead to lower cell productivity and higher power consumption.

Low hydrogen overpotential cathodes, i.e., those metals and metallic alloys having exchange current densities of greater than $10^{-8}$ A/cm$^2$ typically $10^{-8}$ to $10^{-2}$ A/cm, in 1 mol/dm$^3$/$H_2SO_4$ at 20° C. (see Pletcher, Industrial Electrochemistry, Ch. 1, Section 1.5.1, 1993 Blackie A&P, 2nd ed.), including metals such as iron, copper, chromium, and nickel and metallic alloys such as stainless steels are not expected to provide suitable performance for the reasons stated above. However, Applicant has found that the use of a low hydrogen overpotential cathode, unexpectedly provide Conradson carbon decrease. Thus, stainless steel has been found to provide performance comparable to high hydrogen overpotential metals such as lead, cadmium and zinc and a certain alloy of nickel and copper has also been found to be effective in decreasing Conradson carbon number.

A wide variety of petroleum streams, including distillates thereof may be treated according to the process of the present invention to produce petroleum hydrocarbon fractions having a decreased Conradson carbon number. The starting feedstocks are hydrocarbonaceous petroleum streams or fractions having a Conradson carbon number typically of at least about 0.1% by weight, and usually at least about 5% by weight. The process is applicable to distillates and other Conradson carbon containing product feeds resulting from various refinery processes, but is particularly effective when employed to treat heavy hydrocarbon feeds, e.g., those containing residual oils. Advantageously, therefore, the process of the present invention is utilized for the treatment of hydrocarbonaceous petroleum streams of fossil fuels such as whole or topped crude oils and residua. These include heavy oils, such as atmospheric residum (boiling above about 650° F., 343° C.) and vacuum residum (boiling above about 1050° F., 566° C.), heavy crudes, process resids (bottoms), i.e., catalytic cracker bottoms, tars, e.g., steam cracker tars, distillation resids, deasphalted oils and resins and coker oils. Virgin crude oils obtained from any area of the world such as the Middle East as well as heavy gas oils, shale oils, tar sands or syncrude derived from tar sands, distillation resids, coal oils, asphaltenes and other heavy petroleum fractions and distillates thereof can be treated by the process of this invention.

The petroleum feed preferably should be in a liquid or fluid state at process conditions. This may be accomplished by heating the material or by treatment with a suitable solvent as needed. This assists in maintaining the mixture of the Conradson carbon-containing petroleum stream and aqueous electrolysis medium in a fluid form to allow passage of cathodic current. Current densities of 1 mA/cm$^2$ of cathode surface area or greater area are suitable.

Preferably droplets should be of sufficient size to enable the components to achieve intimate contact with the aqueous electrolysis medium. Droplet size particles of about 0.1 micron to 1.0 mm, for example are suitable. Contacting is typically accomplished by intimate mixing of the petroleum stream and the aqueous electrolysis medium to form a mixture or oil-in-water dispersion, for example using a stirred batch reactor or turbulence promoters in flowing cells.

Desirably the process should be carried out for a time and at conditions within the ranges disclosed sufficient to achieve a decrease, preferably a maximum decrease, in Conradson carbon number.

Reaction temperatures will vary with the particular petroleum stream due to its viscosity, and the type of electrolyte and its pH. However, temperatures may suitably range from about ambient to about 700° F. (371° C.), preferably from 100° F. (38° C.) to 200° F. (93° C.), and pressures of from 0 atm (0 kPa) to 210 atm (21,200 kPa), preferably 0 atm (0 kPa) to 3 atm (303 kPa). Within the process conditions disclosed a liquid or fluid phase or medium is maintained.

The electrolyte in the aqueous electrolysis medium is desirably an electrolyte that dissolves or dissociates in water to produce electrically conducting ions at the required pH, but that does not undergo redox in the range of applied potentials used. Organic electrolytes include quaternary carbyl and hydrocarbyl onium salts, e.g. alkylammonium hydroxides. Inorganic electrolytes include, e.g., NaOH, KOH and sodium phosphates. Mixtures thereof also may be used. Suitable onium ions include mono- and bis-phosphonium, sulfonium and ammonium, preferably ammonium ions. Carbyl and hydrocarbyl moieties are preferably alkyl. Quaternary alkyl ammonium ions include tetrabutyl ammonium, and tetraethyl ammonium. Optionally, additives known in the art to enhance performance of the electrodes or the system may be added such as surfactants, detergents, emulsifying agents and anodic depolarizing agents. Basic electrolytes are most preferred. The concentration of electrolyte in the electrolysis medium should be sufficient to generate an electrically conducting solution in the presence of the petroleum component to be treated. Typically an electrolyte concentration of 1–50 wt % of the aqueous phase, preferably 5–35 wt % is suitable.

Within the process conditions disclosed, the pH of the aqueous electrolysis medium can vary from 7 to 14, more from above 7 to 14.

It is possible to carry out the process in air or under an inert atmosphere. The process may be operated under ambient temperature and atmospheric pressure, although higher temperature and pressures also may be used as needed. The process is carried out in an electrochemical cell, by electrolytic means, i.e., in a non-electrostatic mode, as passage of current through the mixture or oil-in-water dispersion is required (e.g., relatively low voltage/high current). The cell may be either divided or undivided. Such systems include stirred batch or flow through reactors. The foregoing may be purchased commercially or made using technology known in the art. Included as suitable electrodes are three-dimensional electrodes, such as metallic foams, stacks of metal mesh or expanded metal sheets.

The cathodic voltage is in the range 0–-3.0 V versus Saturated Calomel Electrode (SCE), preferably −1.0 to −2.5 V based on the characteristics of the particular petroleum fraction. While direct current is typically used, electrode performance may be enhanced using alternating current, or other voltage/current waveforms.

The Conradson carbon content can be determined using the micro-carbon residue (MCR) method, ASTM D-4530-85. According to ASTM D 4530-85, MCR is equivalent to Conradson carbon.

The invention may be described with reference to the following non-limiting examples.

EXAMPLE 1

One hundred grams of deasphalted vacuum resid were combined with 400 milliliters of an aqueous electrolyte consisting of 35 wt % sodium hydroxide, 5% tetrabutylammonium hydroxide and 0.5 milliliters of non-ionic surfactant, octylphenoxy polyethoxy ethanol (Triton®-x-100 from Union Carbide). This mixture was added to a glass vessel and heated to 110° C. under 40 kPA pressure of nitrogen and recirculated to produce a fine oil-in-water dispersion. The electrochemical cell consisted of two flat plate metallic electrodes (1.27×30.5 cm) separated by a 3.2 mm gap. The experiment was conducted at a controlled current of 1.0 amp, which corresponds to a current density of 258 A/m$^2$.

At the end of each run the petroleum phase was isolated from the electrolyted and analyzed by MCR method. The results of the five runs represented in Table 1 below.

| Cathode | CCN | Relative Decrease in CCN |
|---|---|---|
| Cadmium | 6.18 | 1.00 |
| Lead | 6.95 | 0.52 |
| Zinc | 6.55 | 0.77 |
| Stainless Steel | 6.54 | 0.77 |
| Alloy 400* | 7.57 | 0.15 |

* 66% nickel, 31% copper, 1.4% iron, 0.15% carbon

What is claimed is:

1. A process for electrochemically decreasing the Conradson carbon number of petroleum streams, comprising: contacting a hydrocarbon-soluble Conradson carbon containing petroleum stream and an aqueous electrolysis medium with a low hydrogen overpotential metal cathode at an electric current and pH sufficient to decrease the Conradson carbon number of the petroleum stream.

2. The process of claim 1 wherein the low hydrogen overpotential cathode has an exchange current density of $10^{-8}$ to $10^{-2}$ A/cm$^2$ at 20° C. in 1 mol/dm$^3$ $H_2SO_4$.

3. The process of claim 1 wherein the low hydrogen overpotential cathode is a metal selected from iron, copper, nickel, and chromium and alloys thereof and stainless steels.

4. The process of claim 1 wherein the electric current is at a cathodic voltage of from 0 to −3.0 V vs. SCE.

5. The process of claim 1 wherein the electric current is at a cathodic voltage of from about −1.0 to −2.5 V vs. SCE.

6. The process of claim 1 wherein the petroleum stream is selected from the group consisting of crude oils, catalytic cracker feeds, bitumen, and distillation resids.

7. The process of claim 1 wherein the aqueous electrolysis medium contains salts selected from the group consisting of inorganic salts, organic salts and mixtures thereof.

8. The process of claim 1 wherein the aqueous electrolysis medium has a pH of from 7 to 14.

9. The process of claim 1 wherein the aqueous electrolysis medium has a pH of from above 7 to 14.

10. The process of claim 1 wherein the temperature is up to 700° F. (371° C.).

11. The process of claim 1 wherein the pressure is from about 0 atm (0 kPa) to about 210 atm (21,200 kPa).

12. The process of claim 1 wherein the concentration of the electrolyte in the aqueous electrolysis medium is 1 to 50 wt %.

13. The process of claim 1 wherein the petroleum stream and aqueous electrolysis medium form an oil in water dispersion.

* * * * *